US007241483B2

(12) United States Patent
Ausen et al.

(10) Patent No.: US 7,241,483 B2
(45) Date of Patent: Jul. 10, 2007

(54) RETICULATED WEBS AND METHOD OF MAKING

(75) Inventors: Ronald W. Ausen, St. Paul, MN (US); Jayshree Seth, Woodbury, MN (US); Janet A. Venne, Roseville, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 137 days.

(21) Appl. No.: 10/863,720

(22) Filed: Jun. 8, 2004

(65) Prior Publication Data

US 2005/0271858 A1 Dec. 8, 2005

(51) Int. Cl.
*B32B 3/06* (2006.01)

(52) U.S. Cl. ..... 428/100; 24/450; 428/137; 442/2; 442/49

(58) Field of Classification Search ..... 428/100, 428/99, 131, 132, 137, 174, 175, 182, 283; 24/442, 450, 452; 228/174; 442/2, 49
See application file for complete search history.

(56) References Cited

U.S. PATENT DOCUMENTS

| | | | | |
|---|---|---|---|---|
| 3,266,113 | A | | 8/1966 | Flanagan, Jr. |
| 3,447,207 | A | | 6/1969 | Danzer |
| 3,557,413 | A | | 1/1971 | Engle |
| 3,594,870 | A | | 7/1971 | Schippers et al. |
| 4,001,366 | A | | 1/1977 | Brumlik |
| 4,056,593 | A | | 11/1977 | de Navas Albareda |
| 4,101,625 | A | | 7/1978 | Haley |
| 4,189,809 | A | | 2/1980 | Sotos |
| 4,894,060 | A | * | 1/1990 | Nestegard ..... 604/391 |
| 5,344,691 | A | | 9/1994 | Hanschen et al. |
| 5,354,597 | A | | 10/1994 | Capik et al. |
| 5,462,708 | A | | 10/1995 | Swenson et al. |
| 5,501,675 | A | | 3/1996 | Erskine |
| 5,555,608 | A | | 9/1996 | Allan |
| 5,891,549 | A | * | 4/1999 | Beretta et al. ..... 428/100 |
| 5,976,665 | A | * | 11/1999 | Hansson ..... 428/136 |
| 6,209,177 | B1 | | 4/2001 | Murasaki |
| 2003/0096548 | A1 | | 5/2003 | Dieter et al. |

FOREIGN PATENT DOCUMENTS

| | | |
|---|---|---|
| EP | 0 836 929 | 4/1998 |
| WO | WO 93/009690 | 5/1993 |

* cited by examiner

*Primary Examiner*—Nasser Ahmad
*Assistant Examiner*—Brent O'Hern
(74) *Attorney, Agent, or Firm*—William J. Bond

(57) ABSTRACT

The present invention concerns a reticulated web, mesh or netting the polymeric netting comprising two sets of strands at angles to each other and formed from a profile extruded three dimensional film having a first face and a second face. The profile extruded film is cut in regular intervals along the X-dimension on one or more faces or alternatively in alternating fashion on the first face and the second face. The cut film is then stretched (oriented) in the lengthwise dimension creating a nonplanar netting characterized by land portions on the top and bottom surfaces with connecting leg portions extending between the land portion on the top and bottom surfaces.

17 Claims, 16 Drawing Sheets

RETICULATED WEBS AND METHOD OF MAKING

SUMMARY OF THE INVENTION

The present invention concerns an extrusion formed reticulated web, mesh or netting, which can be formed as reticulated hook fasteners for use with hook and loop fasteners.

BACKGROUND OF THE INVENTION

A method of forming a reticulated hook element is disclosed in U.S. Pat. No. 4,001,366 which describes forming hooks by known methods, similar to that disclosed in U.S. Pat. Nos. 4,894,060 and 4,056,593, discussed below. A reticulated web or mesh structure is formed by intermittently slitting (skip slit) extruded ribs and bases and then stretching to expand the skip slit structure into a mesh.

U.S. Pat. No. 4,189,809 describes a self-mating hook formed by extrusion of hook profiles having legs extending from a backing. The hook profiles and the legs are cut through thereby opening a gap between the cut legs under the row of hooks. This gap creates the female portion with which the hook profile can engage.

U.S. Pat. No. 5,891,549 describes a method for forming a net sheet having surface protrusions thereon. The net is used primarily as a spacer for drainage and like applications. The net has parallel elements that extend at right angles to each other and would appear to be formed by a direct molding process involving directly extruding the net-like structure onto a negative mold of the netting.

A film extrusion process for forming hooks is proposed, for example, in U.S. Pat. Nos. 4,894,060 and 4,056,593, which permits the formation of hook elements by forming rails on a film backing. Instead of the hook elements being formed as a negative of a cavity on a molding surface, as is the more traditional method, the basic hook cross-section is formed by a profiled extrusion die. The die simultaneously extrudes the film backing and rib structures. The individual hook elements are then preferably formed from the ribs by cutting the ribs transversely, followed by stretching the extruded strip in the direction of the ribs. The backing elongates but the cut rib sections remain substantially unchanged. This causes the individual cut sections of the ribs to separate each from the other in the direction of elongation forming discrete hook elements. Alternatively, using this same type extrusion process, sections of the rib structures can be milled out to form discrete hook elements. With this profile extrusion, the basic hook cross section or profile is only limited by the die shape and hooks can be formed that extend in two directions and have hook head portions that need not taper to allow extraction from a molding surface.

BRIEF DESCRIPTION OF THE INVENTION

The present invention is directed at a polymer netting formed from a profile extruded film. The profile extruded film is three dimensional and has a first face and a second face. The profile extruded film is cut in regular intervals along the X-dimension on one or more faces or alternatively in alternating fashion on the first face and the second face. The cut film is then stretched (oriented) in the lengthwise dimension creating a nonplanar netting characterized by land portions on the top and bottom surfaces with connecting leg portions extending between the land portion on the top and bottom surfaces. The polymer netting is preferably made by a novel adaptation of a known method of making hook fasteners as described, for example, in U.S. Pat. Nos. 3,266,113; 3,557,413; 4,001,366; 4,056,593; 4,189,809 and 4,894,060 or alternatively 6,209,177, the substance of which are incorporated by reference in their entirety.

The preferred method generally includes extruding a thermoplastic resin through a die plate, which die plate is shaped to form a nonplanar film (three dimensional) preferably with a regularly oscillating peak and valley structure that oscillates from a top surface to a bottom surface forming longitudinally extending ridges on both faces of the film. The netting is formed by transversely cutting the oscillating film in the thickness dimension (Z dimension) at spaced intervals along the length (X dimension), at a transverse angle, to form discrete cut portions. The cuts can be on one or both faces of the oscillating film. Subsequently, longitudinal stretching of the film (in the direction of the ridges or the X dimension or direction) separates these cut portions of the film backing, which cut portions then form the connecting legs of the reticulated mesh or netting. The legs create the transverse extending strands (Y dimension) of the netting. The ridges between the cut lines on the uncut face create lands and these uncut portions of the ridges in the lengthwise direction form the lengthwise strands of the netting.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENT

Figure 1:
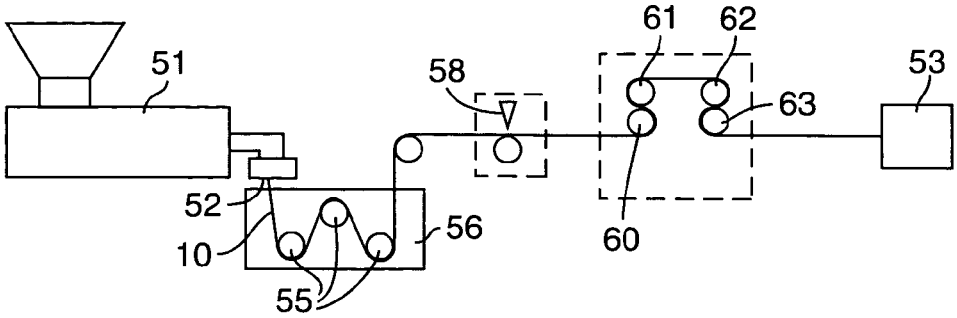
FIG. 1 is a schematic view of a method of forming the invention netting.
Figure 4:
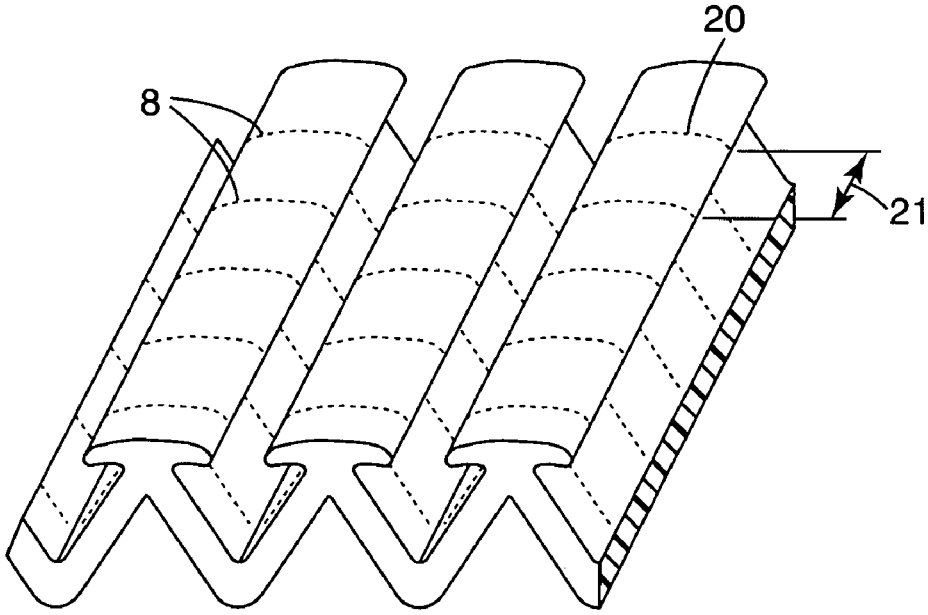
FIG. 4 is a perspective view of the FIG. 3 film cut on one face at regular intervals.
Figure 13:
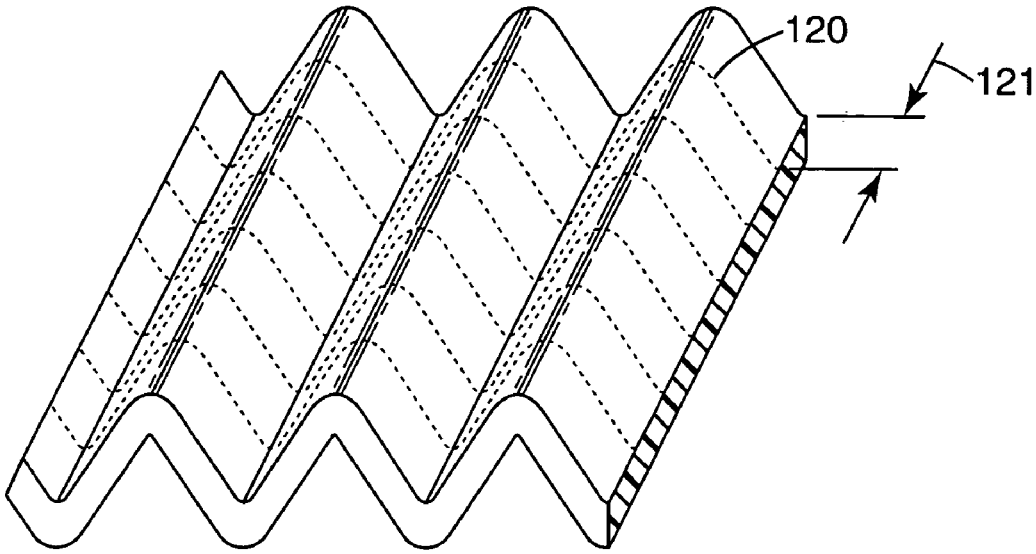
FIG. 13 is a perspective view of the FIG. 12 film cut on one face at regular intervals.

A method for forming a reticulated mesh or netting of the invention is schematically illustrated in FIG. 1. Generally, the method includes first extruding a profiled film through a die plate 1, shown in FIG. 2. The thermoplastic resin is delivered from an extruder 51 through the die 52 having die plate 1 with a cut opening 2. The die can be cut, for example, by electron discharge machining, shaped to form the nonplanar film 10 which optionally can have elongate spaced structure 7 extending along one or both surfaces 3 and 4 of the film 10. If elongate spaced structures 7 are provided on one or both surfaces 3 and 4 of the film 10, the structures 7 can have any predetermined shape, including that of hook portions or members. The nonplanar film 10 generally is pulled around rollers 55 through a quench tank 56 filled with a cooling liquid (e.g., water), after which the film 10 is transversely slit or cut at spaced locations 8 along its lengths by a cutter 58 to form discrete cut portions of the film 10. As shown in FIGS. 4 and 13, the distance between the cut lines 20, 120 corresponds to about the desired width 21, 121 of the cut portions 31, 131 to be formed, as is shown, for example, in FIGS. 5 and 14. The cuts 20, 120 can be at any desired angle, generally from 30° to 90°, from the lengthwise extension of the film (X-direction). Optionally, the film can be stretched prior to cutting to provide further molecular orientation to the polymeric film 10, 110 and reducing the thickness 14, 114 of the film 10, 110 and any structures on the film. The cutter can cut using any conventional means such as reciprocating or rotating blades, lasers, or water jets, however preferably the cutter uses blades oriented at an angle of about 60 to 90 degrees with respect to lengthwise extension of the film 10, 110.

Figure 3:
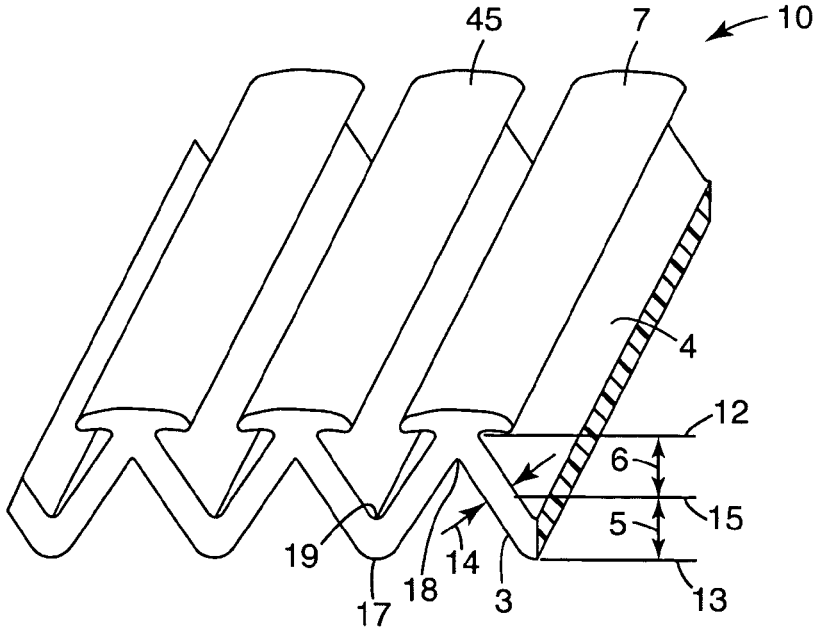
FIG. 3 is a perspective view of a first embodiment precursor film in accordance with the present invention having hook elements.
Figure 12:
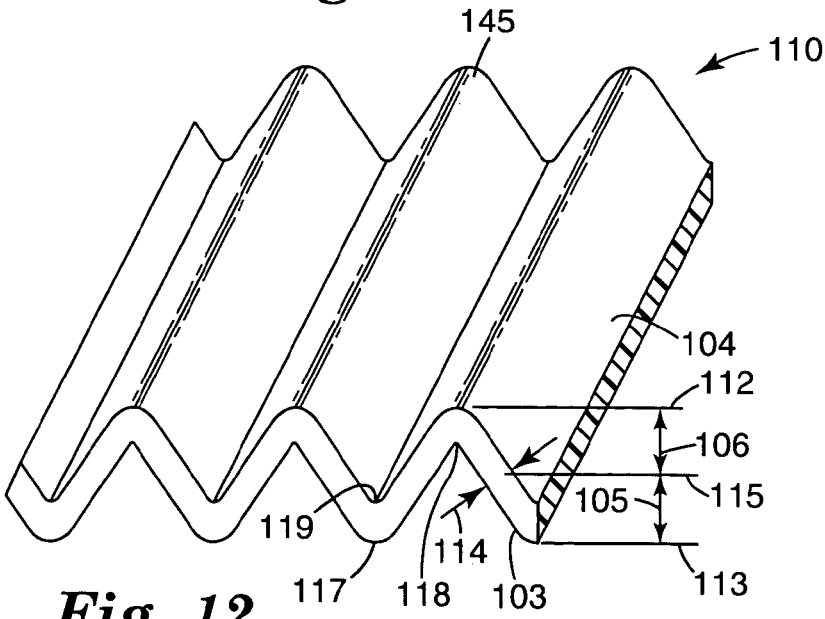
FIG. 12 is a perspective view of a precursor film used in accordance with the present invention.

The film 10, 110 as shown in FIGS. 3 and 12 has a first top face 4, 104 and a second bottom face 3, 103 with a film thickness 14, 114 of from 25 microns to 1000 microns, preferably 50 microns to 500 microns. The film 10, 110 is nonplanar where the film oscillates, such as by peaks and valleys in the form of substantially continuous ridges, from a first upper plane 12, 112 to a second lower plane 13, 113. By this, it is meant the film itself, or the continuous film backing not structures on the film surface, is nonplanar and oscillates from the upper plane to the lower plane. The film backing oscillates around a midline 15, 115 and the nonplanar film is characterized by a first half extending 6, 106 on one side of the midline 15, 115 and a second 5, 105 half extending on the opposing side of the midline 15, 115. The peaks of the ridges on the film backing or the top of structure 45, 145, on the top face of the film, generally extend at least to the upper plane 12, 112. The peaks of the ridges on the film backing, or individual peaks 45, 145 can terminate below or above the upper plane 12, 112 preferably at a point between the midline 15, 115 and the top plane 12, 112. The peaks 17, 117 on the bottom face 3, 103 of the film backing also extend generally at least to the lower plane 13, 113. However, again the film backing plane or individual peaks can terminate above or below the lower plane 13, 113 and preferably between the midline 15, 115 and the lower plane 13, 113. The peaks generally alternate from the lower plane 13, 113 to the upper plane 12, 112 but multiple peaks can extend, in a row, to either the upper plane or the lower plane without extending to the other half of the nonplanar film face by having the intermediate peaks only extending to the midline, or below the midline, on the same side of the midline. Generally, the nonplanar film will have at least about 2 peaks (45, 145 and/or 17, 117) per linear centimeter (cm) and preferably at least 5 extending up to 50 peaks per linear centimeter. Each peak preferably will extend past the midline of the film to an extent such that the underside 18, 118 of the peak extends past the underside of 19, 119 of the adjacent opposing peak by at least 10 microns, preferably at least 50 microns. The distance 6, 106 or 5, 105 between the midline and the upper plane 12, 112 or lower plane 13, 113 is generally about 50 microns to 1000 microns preferably about 100 microns to 500 microns.

The film is then cut on either the upper face 4, 104 or the lower face 3, 103 from the upper plane 12, 112 toward the midline 15, 115 or from the lower plane 13, 113 toward the midline 15, 115, as shown, for example, in FIGS. 4 and 13. The cuts 20 or 120 extend from the upper or lower plane at least through the undersides 18, 118 or 19, 119 of the peaks. At least some of the peaks 45, 145 on the face are cut and preferably all or substantially all of the peaks are cut. The cuts 20 or 120 will preferably at least extend to the midline of a film backing. Generally the cuts can extend so that they go to the undersides of the opposing peaks. Preferably, the cuts will terminate before reaching substantially all of the undersides of the opposing peaks to avoid severing the film. Undersides of the peaks on one face will form the valleys of the opposing face. In an alternative embodiment, the film can be cut on both faces as described above as long as the cuts on opposing faces are offset so as not to completely sever the film. The distance between cuts 21, 121 and 221, which forms the cut portions 31, 131 and 231, is generally 100 microns to 1000 microns, preferably from 200 microns to 500 microns. The cut portions 31, 131 form the strands 44, 144 extending in the cross-direction of the netting 40, 140. The strands 41, 141 extending in the lengthwise direction are formed by the uncut portions of the film. These length wise or longitudinal strands are generally continuous when the film backing is cut on only one face. At least sonic of the cross direction strands 44 and 144 are at least in part generally always continuous when the cuts are continuous.

After cutting of the film 10, 110 the film is longitudinally stretched at a stretch ratio of at least 2:1 to 4:1, and preferably at a stretch ratio of at least about 3:1, preferably between a first pair of nip rollers 60 and 61 and a second pair of nip rollers 62 and 63 driven at different surface speeds preferably in the lengthwise direction. This forms the open three dimensional netting shown in e.g., FIGS. 5, 7, 14 and 16. Roller 61 is typically heated to heat the film prior to stretching, and roller 62 is typically chilled to stabilize the stretched film. Optionally, the film can also be transversely stretched to provide orientation to the film in the cross direction and flatten the profile of the netting formed. The film could also be stretched in other directions or in multiple directions. The above stretching method would apply to all embodiments of the invention. With the films cut on only one face, the open areas 43, 143 and 243 generally are separated by longitudinal strands 41, 141, 241, which strands have a non-recilinear cross-section or are nonplanar along their length or both. The transverse strands are generally nonplanar, although they can be rectilinear in cross-section. Nonplanar strands or a nonplanar netting provides for a more flexible netting which creates breathability both through the film (by the open area of the netting) and along the plane of the reticulated netting, due to its nonplanar nature. The open areas generally comprise about at least 50 percent of the surface area of the netting and preferably at least 60 percent. The surface area of the netting is the planar cross-sectional area of the netting in the X-Y plane. This large percentage open area creates an extremely flexible and breathable netting. The hook heads formed on hook nettings are preferably smaller than the individual openings in the netting in the direction parallel with the hook head overhangs such that the hook netting is non-self engaging. In the hook netting embodiment of FIGS. 5-10 this would be the transverse direction Y.

Stretching causes spaces 43, 143 and 243 between the cut portions 31, 131 and 231 of the film and create the longitudinal strands 41, 141 and 241 by orientation of the uncut portions of the film. The transverse strands 44, 144 are formed by interconnected cut portions each of which has leg portions which join at the peak 45, 145. The leg portions of adjacent cut portions are connected by strands (e.g., 41, 141 or 241) or the uncut film portions.

Figure 5:
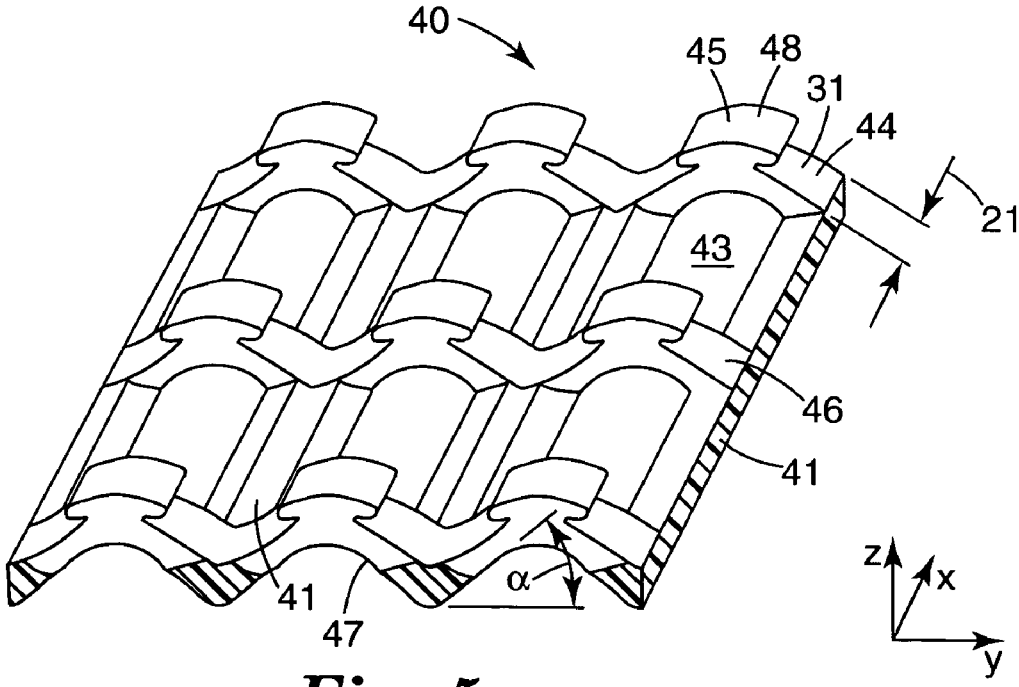
FIG. 5 is a perspective view of a first embodiment netting in accordance with the present invention having hook elements.
Figure 5A:
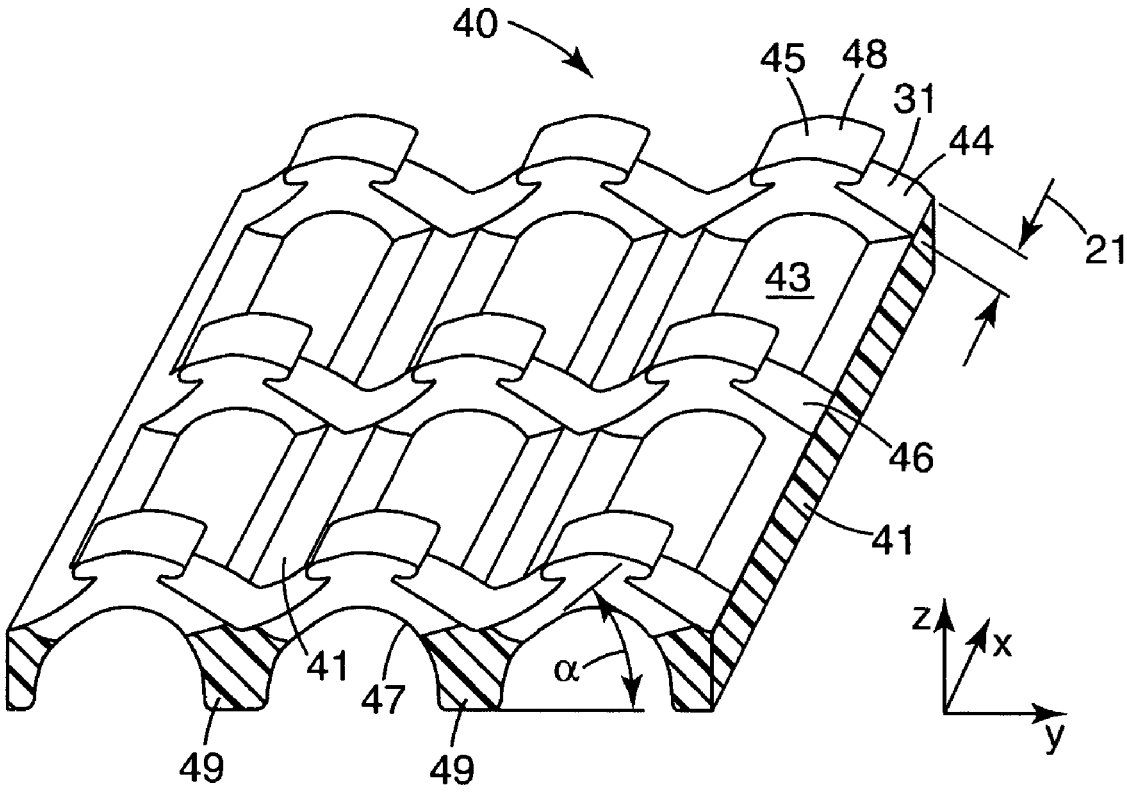
FIG. 5*a* is a perspective view of a second embodiment netting in accordance with the present invention having hook elements.
Figure 14:
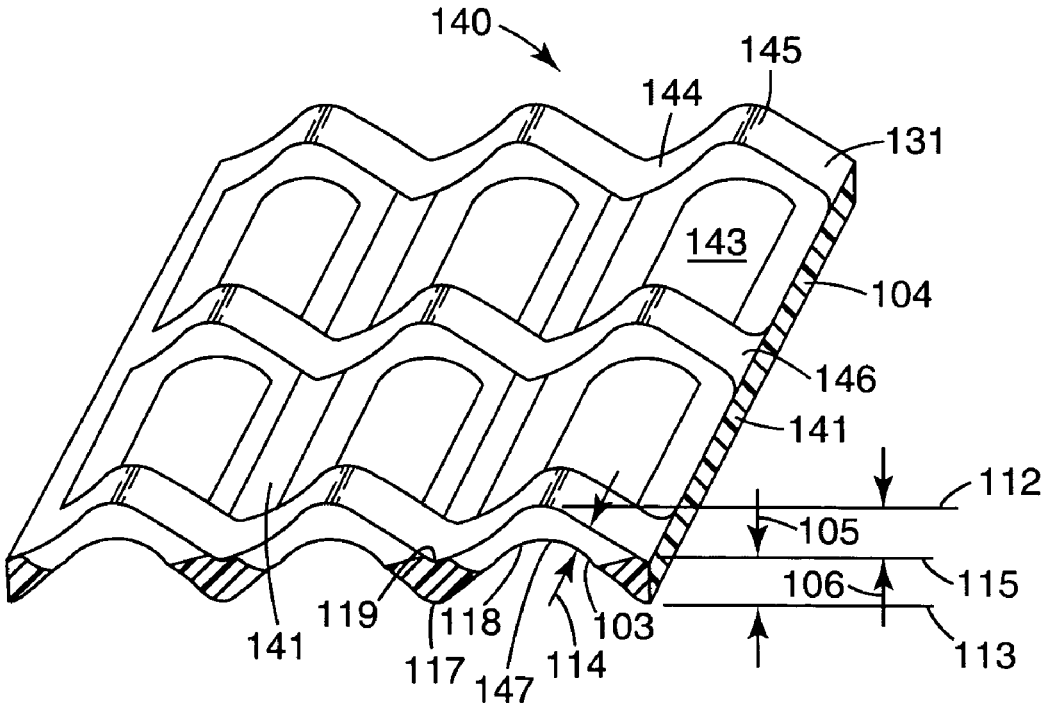
FIG. 14 is a perspective view of a netting in accordance with the present invention without hook elements produced from the FIG. 13 cut film.
Figure 15:
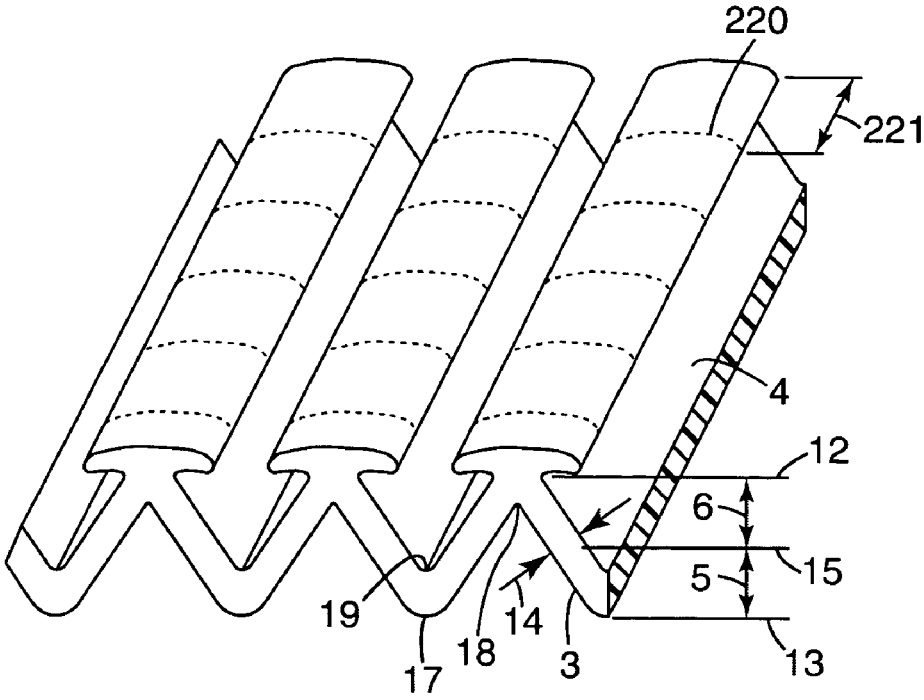
FIG. 15 is a perspective view of the FIG. 3 film cut at regular intervals at a different depth.
Figure 16:
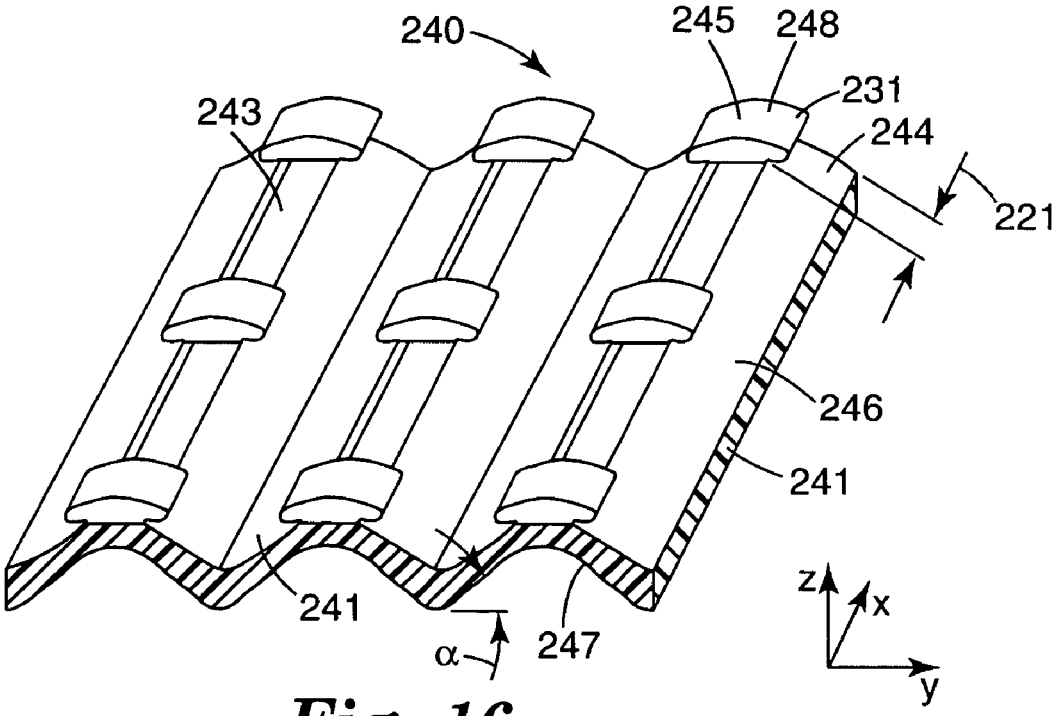
FIG. 16 is a perspective view of a netting produced from the FIG. 15 cut film.

FIGS. 5, 14 and 16 are exemplary polymeric mesh or nettings, which can be produced, according to the present invention, generally designated by the reference numerals 40, 140, 240. The netting comprises upper 46, 146, 246 and lower 47, 147, 247 major surfaces. The cut ridges on the upper surface 46, 246 form a multiplicity of hook members 48 and 248.

The netting is formed having transversely extending strands that are created by the cut portions of the three-dimensional film extending in the cross direction and longitudinally extending strands created by at least in part by uncut portions of the film. When tension or stretching is applied to the film in the lengthwise direction, the cut portions 31, 131, 231 of the film separate, as shown in the embodiments of FIGS. 5, 14 and 16. When the film is cut on only one face, the uncut portions of the film, between cut lines, are aligned in the lengthwise direction resulting in formation of linear strands 41, 141, 241 extending in the lengthwise direction upon stretching or tensioning of the cut film. The transverse strands 44, 144 are created by the cut portions in the embodiments shown in FIGS. 5 and 14. The cut portions connect the longitudinal strands 41, 141, 241 formed by the uncut portions. In the FIGS. 5 and 16 embodiments, the hook elements formed on the cut portions form a reticulated netting having hook engaging elements providing a breathable, compliant and deformable hook netting. A hook netting of this type is extremely desirable for limited use articles such as disposable absorbent articles (e.g., diapers, feminine hygiene articles, limited use garments and the like).

The invention netting is characterized by having no bond points or bonding material at the cross-over points of the transverse and longitudinal strands. The netting is integrally formed of a continuous material. The connection between the strand elements is created in the film formation process where the strands are created by cutting of an integral film. As such the netting at the cross-over points is a continuous homogeneous polymeric phase. Namely, there are no interfacial boundaries caused by fusion or bonding of separate strand elements at the strand cross-over points. Preferably, at least one set of strands has molecular orientation caused by stretching; this generally would be the longitudinal strands. These oriented strands could be of any cross-sectional profile and would tend to become rounded due to polymer flow during stretching. Orientation creates strength in these strands providing a dimensionally stable web in the direction of orientation with continuous linear strands. Unoriented strands are generally rectilinear in cross-section due to the cutting operation. The two sets of strands generally will intersect a planar face of the netting at an angle $\alpha$, in the Z or thickness direction, of greater than zero (0) generally 20 degrees to 70 degrees, preferably 30 degrees to 60 degrees.

Figure 6:
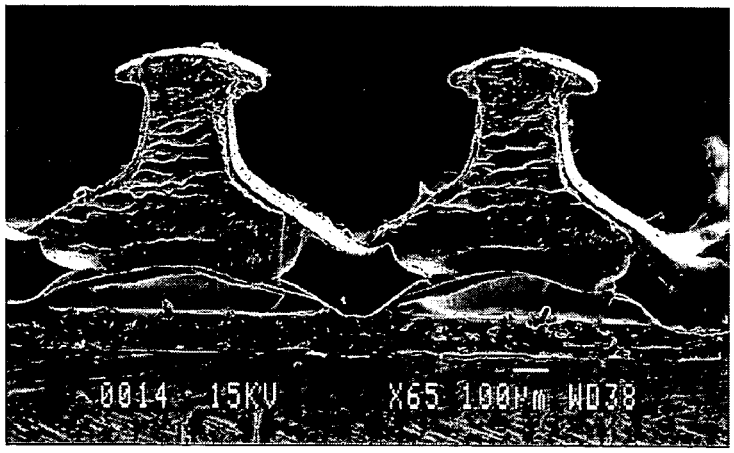
FIG. 6 is a photomicrograph side view of a third embodiment netting of the invention.

The photomicrograph in FIG. 6 shows an alternative netting similar to that of FIGS. 5 or 16 but with a stem 151 on the cut portion 150. The hook head 152 of the hook element 153 extends outwardly from the stem and the overhang 155 is aligned with the legs 156 of the cut portion 150. This provides hook elements that extend further out from the cut portion. Hook elements could also be formed at other locations on the cut portions or be created on the uncut portions by cutting ridges or ribs provided on the uncut portions (not shown) prior to orienting the film.

Figure 8:
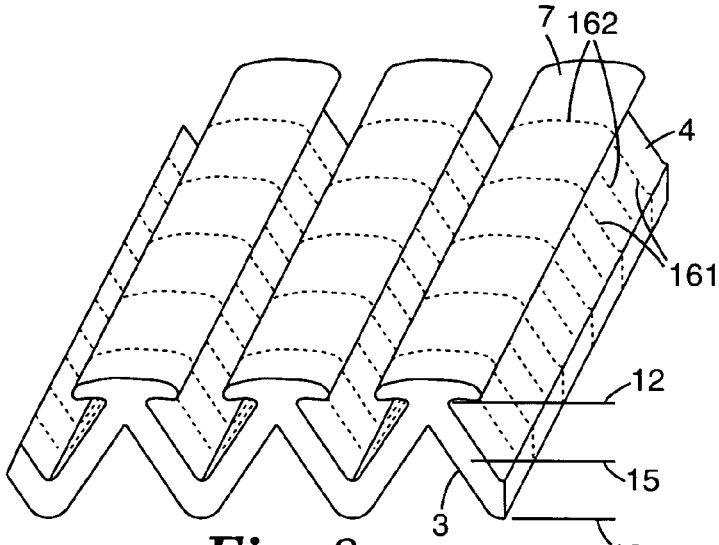
FIG. 8 is a perspective view of a fourth embodiment cut precursor film in accordance with the present invention.
Figure 8A:
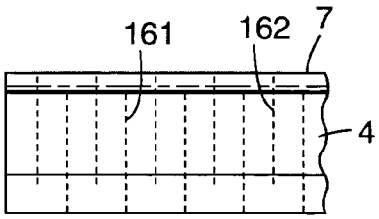
FIG. 8*a* is a side view of the cut precursor film of FIG. 8.
Figure 9:
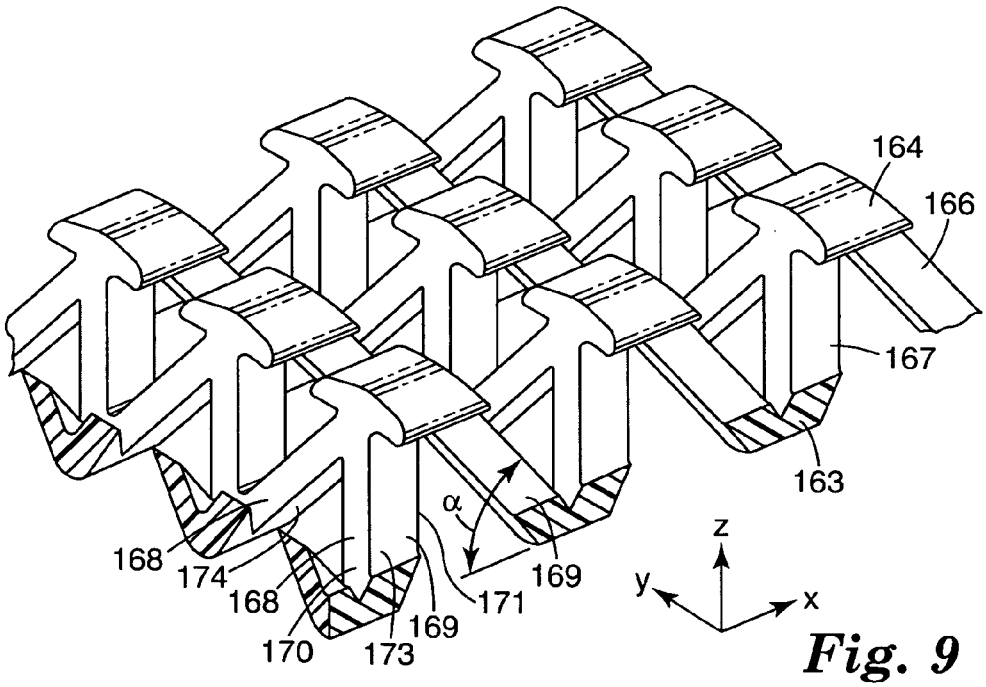
FIG. 9 is a perspective view of a fourth embodiment netting in accordance with the present invention.

FIGS. 8 and 9 show an alternative netting formed from the same precursor film of FIG. 3, however cut in an alternating pattern on opposite sides or faces of the three dimensional film where the opposing cuts 161 and 162 substantially overlap. The cuts 161 and 162 on either face are equally spaced and offset such that the cut on one face is centered between two cuts on the opposing face and vise versa. Alternatively, the cuts could be relatively irregular so long as the cuts or one single cut, on one face, did not match with a single cut on the opposite face, which would result in completely severing of the web. The cuts are generally spaced by at least 100 microns preferably 200 microns to 500 microns. In the embodiment of FIG. 8, when the net precursor film is longitudinally stretched, the resulting netting is as shown in FIG. 9. The overlap in the cuts 161 and 162 result in legs 169 where the side faces 170 and 171 of the legs are defined by opposing cuts. These leg portions form in part the longitudinal strands in combination with the uncut portions 163, 164. Because the film has been cut on opposite faces the uncut portions 163, 164 between adjacent cuts on opposite faces are at different locations in the thickness direction Z. As such, the legs 169 formed by cut portions 166 and 167 connect, in the Z direction, the uncut portions 163 and 164. Adjacent uncut portions are also connected in the transverse or Y direction by cut portions forming the transverse oscillating strands 168. In this embodiment orientation can occur either in the uncut or cut portions when the film is longitudinally oriented, where preferential orientation would occur in the thinnest portion whether that be the cut or uncut portions. Alternatively, little or no orientation can occur, with the film just opening up with lengthwise stretching. In this case there usually is some stress elongation at the points where the cut portions and uncut portions meet.

Figure 10:
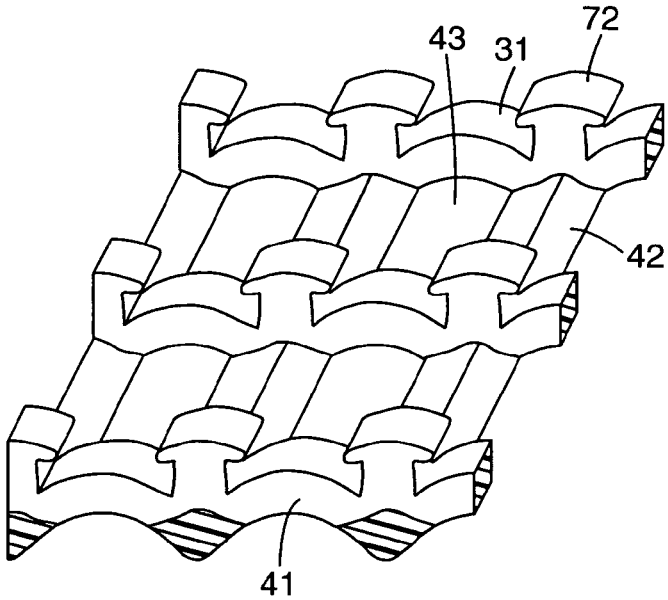
FIG. 10 is a perspective view of an alternative embodiment netting having hook elements.
Figure 11:
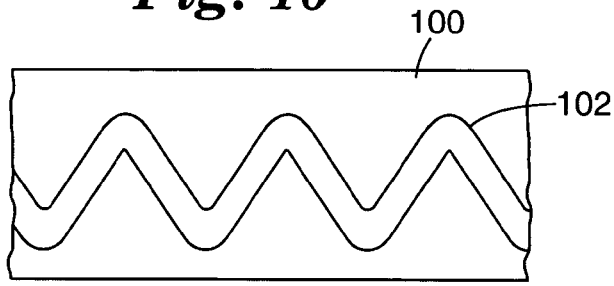
FIG. 11 is a cross-sectional view of a die plate used to form a precursor film used in accordance with the present invention.

FIG. 10 shows an alternative embodiment where the hook forming elements are formed in the valleys of the ridges rather than on the peaks of the ridges, otherwise this embodiment is identical to that of FIG. 5.

Generally, the hook elements are desirable in forming a hook netting however the invention netting can be provided without hook engaging elements as in the embodiment of FIGS. 12-14.

Formed netting can also be heat treated preferably by a non-contact heat source. The temperature and duration of the heating should be selected to cause shrinkage or thickness reduction of at least the hook head by from 5 to 90 percent. The heating is preferably accomplished using a non-contact heating source which can include radiant, hot air, flame, UV, microwave, ultrasonics or focused IR heat lamps. This heat treating can be over the entire strip containing the formed hook portions or can be over only a portion or zone of the strip. Different portions of the strip can be heat treated to more or less degrees of treatment.

Figure 17:
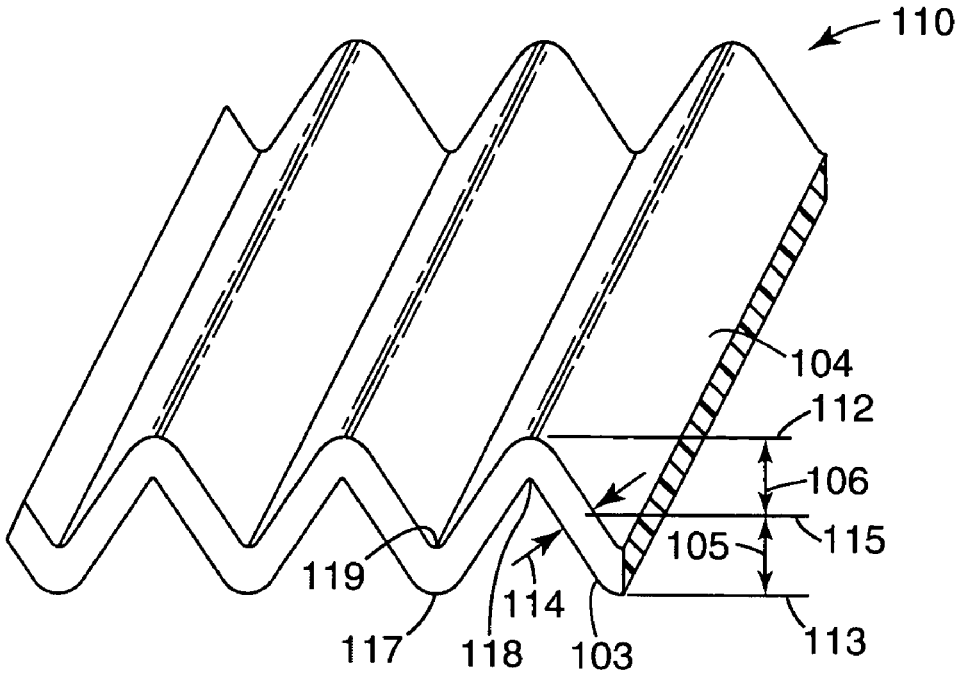
FIG. 17 is a perspective view of a precursor film used in accordance with the present invention.
Figure 18:
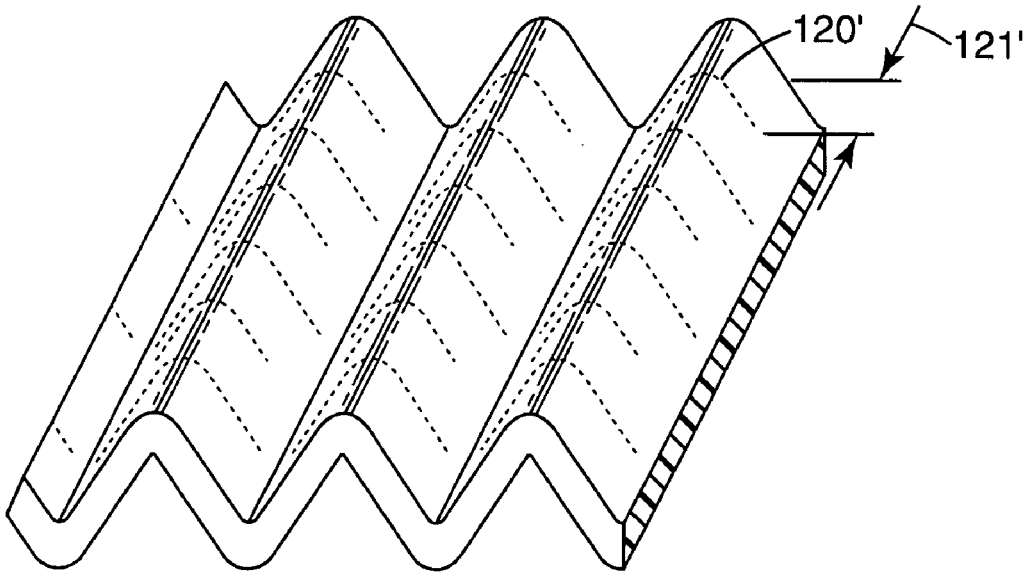
FIG. 18 is a perspective view of the FIG. 17 precursor film cut at regular intervals with varying cut depths.
Figure 19:
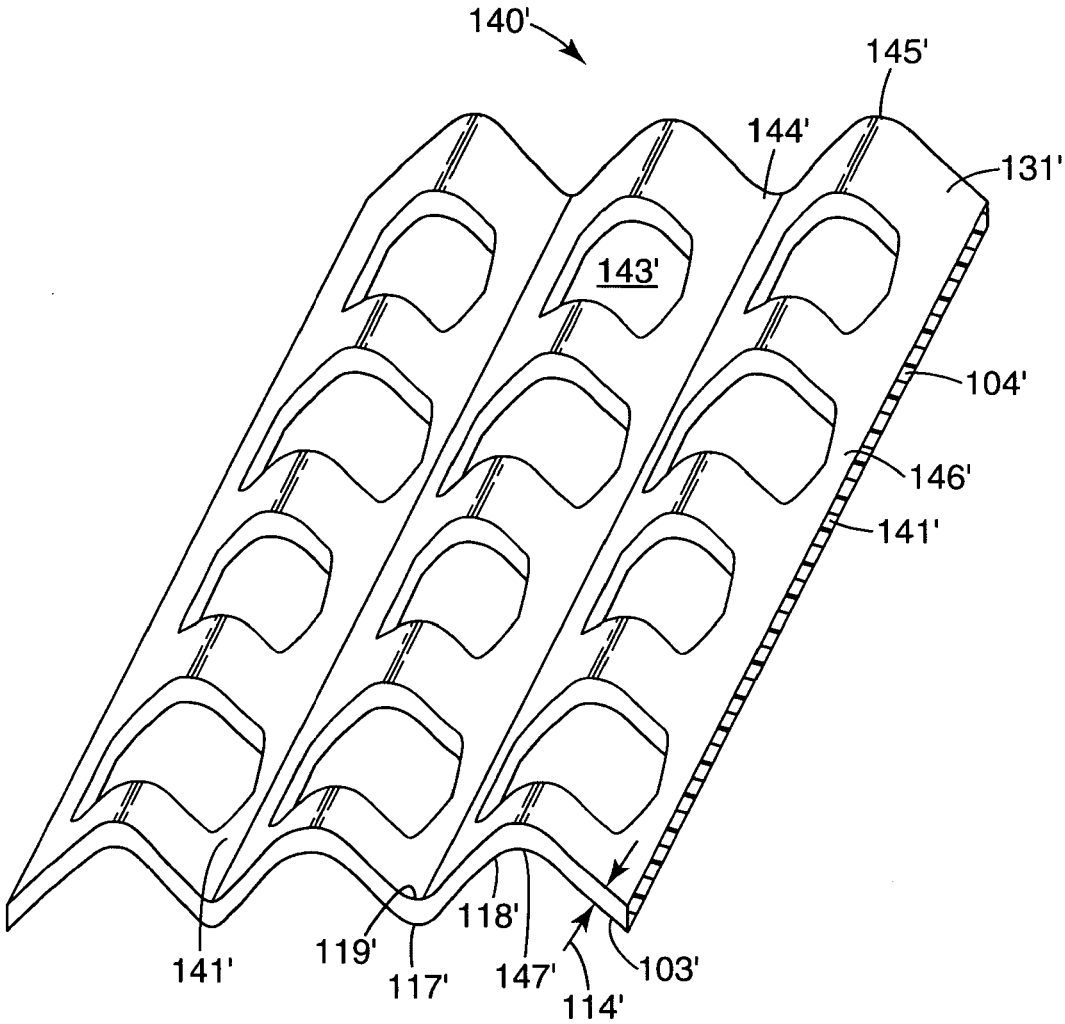
FIG. 19 is a perspective view of the netting produced from the FIG. 18 cut film.

FIG. 17 is the FIG. 12 precursor film, which is then cut in accordance with the cut pattern shown in FIG. 18. This embodiment is substantially the same as that of FIG. 13 except that the cuts 120 are of varying depth in the lengthwise extension of the nonplanar film. This film when longitudinally stretched (the lengthwise direction) results in a netting such as shown in FIG. 19 resulting in spaces 143' between the cut portion 131' and longitudinal strands 141'. The transverse strands 144 ' are formed by interconnected cut portions 131' each of which has leg portions which join at the peaks 145' and at the uncut film portion 141'. The spaces 143' are of varying size depending on the depth of cut with deeper cuts resulting in larger spaces and shallower cuts resulting in smaller spaces 143'.

Figure 20:
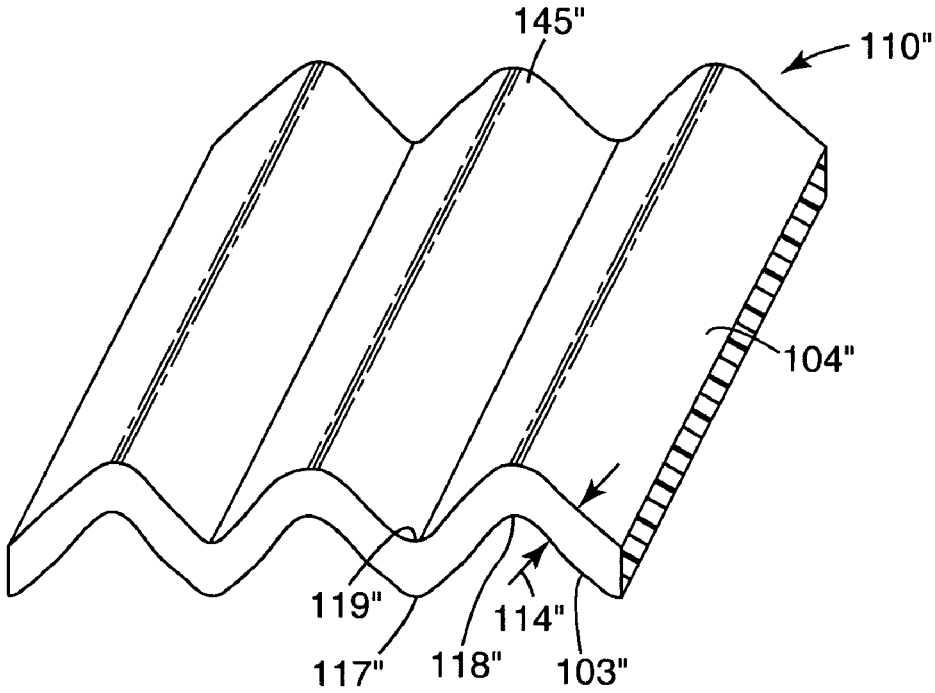
FIG. 20 is a perspective view of a precursor film used in accordance with the present invention.
Figure 21:
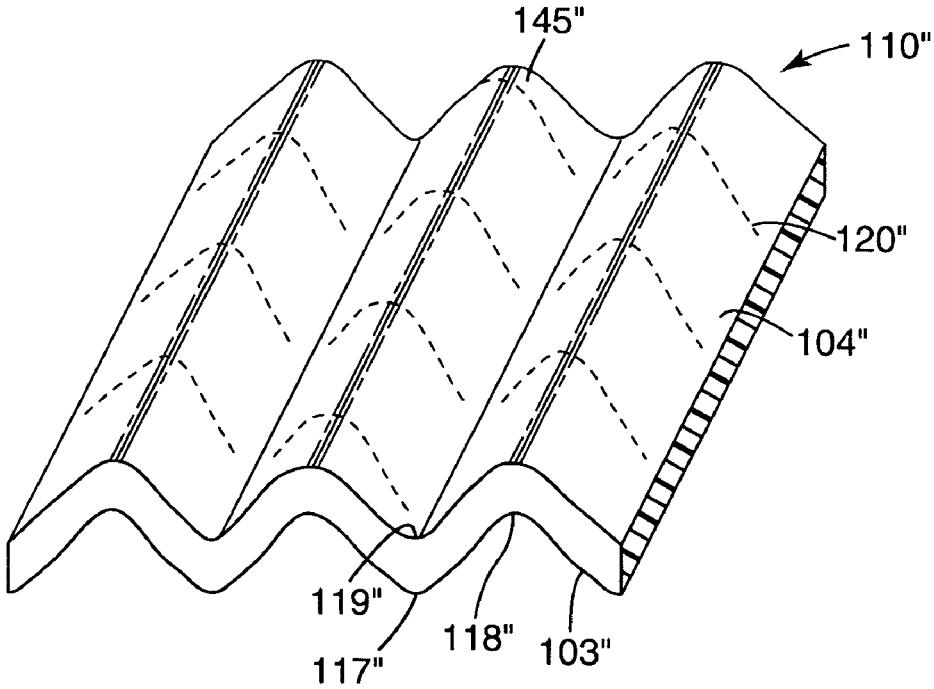
FIG. 21 is a perspective view of the FIG. 20 precursor film cut at an obtuse angle to the ridges.
Figure 22:
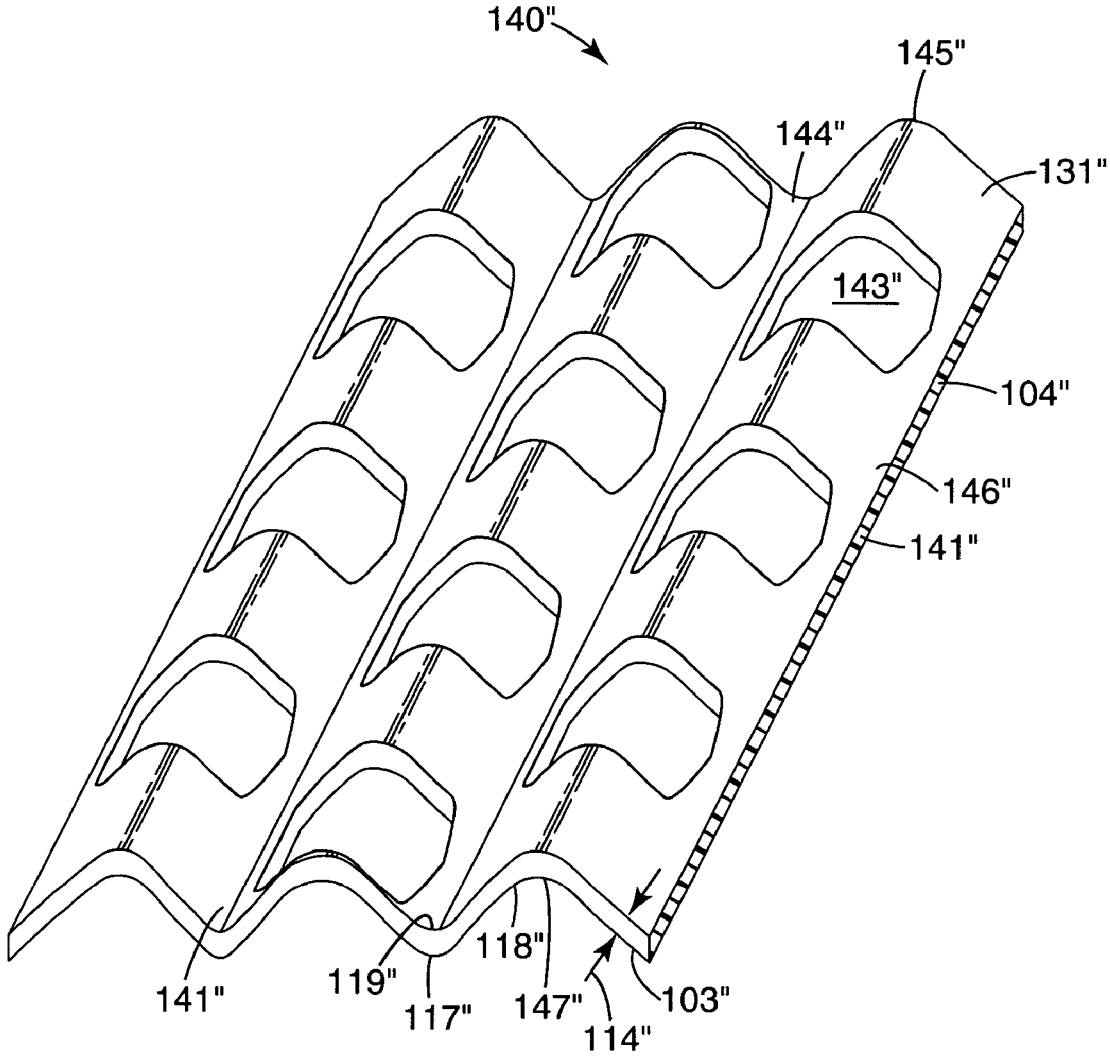
FIG. 22 is a perspective view of the netting produced from the FIG. 21 cut film.

FIG. 20 is the FIG. 12 precursor film which is then cut in accordance with the cut pattern shown in FIG. 21. This embodiment is substantially the same as that of FIG. 13 except that the cuts 120" are at an angle that is relatively non-parallel to the transverse direction of the film 110". This film when longitudinally stretched (the lengthwise direction) results in a netting such as shown in FIG. 22 resulting in spaces 143" between the cut portion 131" and longitudinal strands 141". The transverse strands 144" are formed by interconnected cut portions 131" each of which has leg portions which join at the peaks 145" and at the uncut film portion 141". The spaces 143" are staggered and aligned in the direction of the cuts as are the transverse strands 144".

Figure 23:
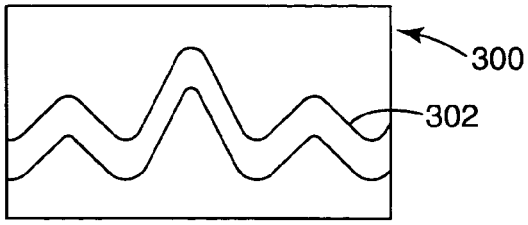
FIG. 23 is a cross-sectional view of a die plate used to form an alternative embodiment precursor film used in accordance with the present invention.
Figure 24:
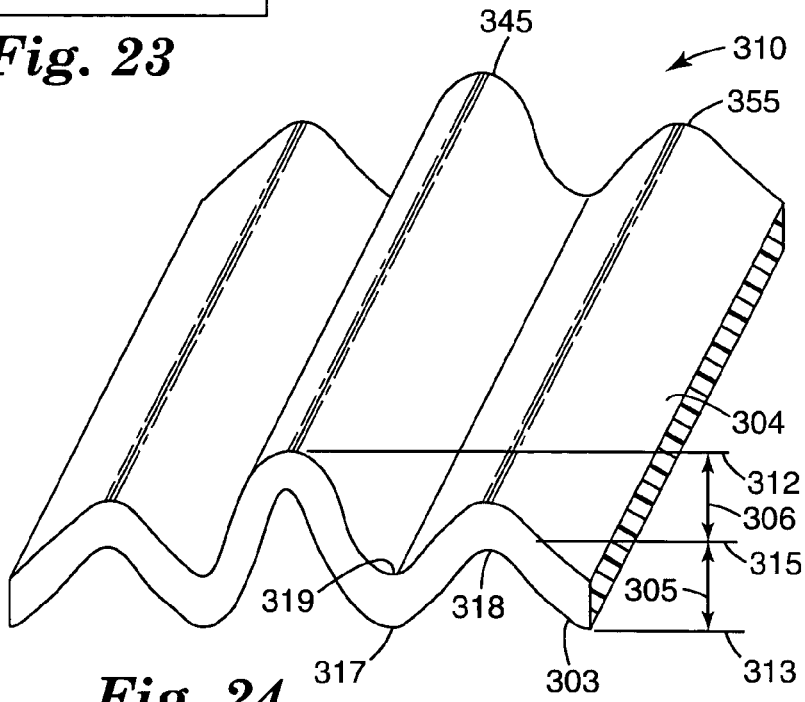
FIG. 24 is a perspective view of a precursor film produced with the FIG. 23 die plate.
Figure 25:
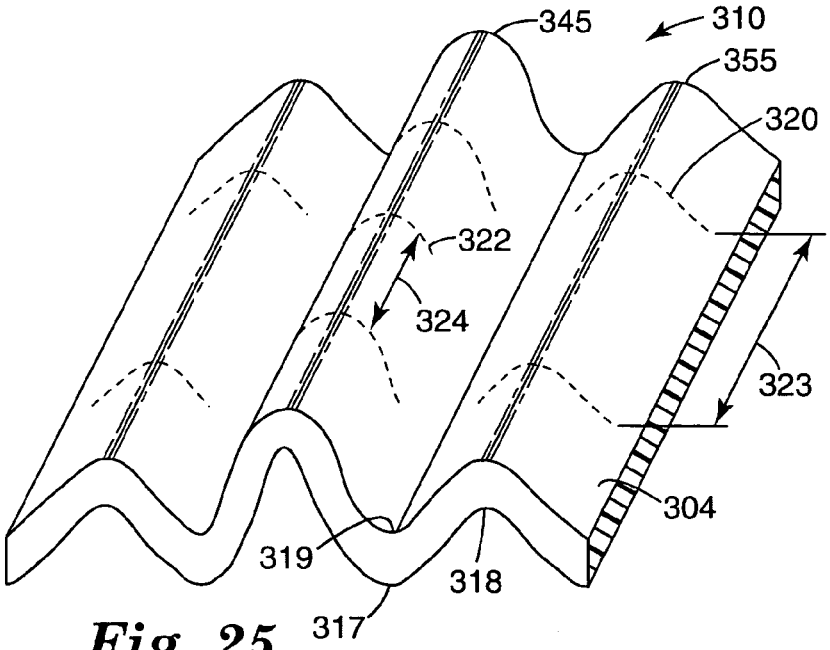
FIG. 25 is a perspective view of the FIG. 24 precursor film cut at alternating depths on one face.
Figure 26:
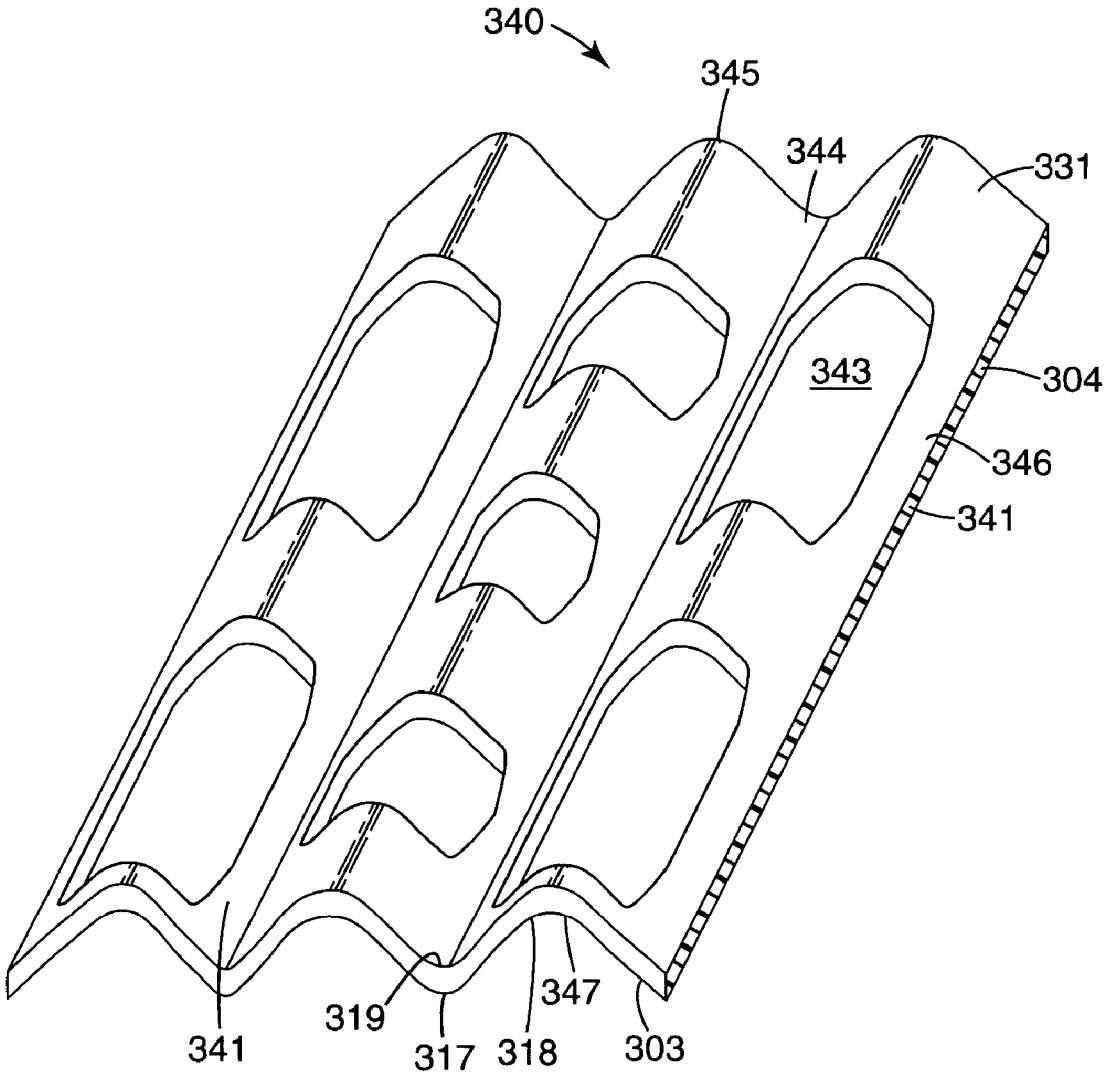
FIG. 26 is a perspective view of a netting produced from the FIG. 25 cut film.

FIG. 23 is an alternative die plate 300 with a cutout 302 shaped to form a precursor film as shown in FIG. 24. In this embodiment, some of the ridges 345 are larger than others with intermediate ridges 355 having peaks terminating below the upper plane 312 but above the midline 315. This film is then cut as in the FIG. 18 embodiment with multiple cuts 322, 320 on one face at varying depths as shown in FIG. 25 cut from the upper face 304 or upper plane 312 towards the midline 315 having an upper half 306 and lower half 305. The lower face 303 is uncut. The deeper cuts 320 extend from the upper plane at least through the undersides of the intermediate ridges 355. The lower ridges 317 are uncut with the cuts terminating prior to the underside 319 of the lower ridges 317. The shallow cuts 322 only cut the larger ridges 345 resulting in the larger ridges 345 having more cuts and at different depths. This results in a netting such as shown in FIG. 26 with many different sizes and shapes of spaces 343, between the various cut portions 331. The transverse strands 344 are similar to those of the embodiment of FIGS. 13 and 18 but are created by the deepest and the most widely spaced cuts.

Figure 27:
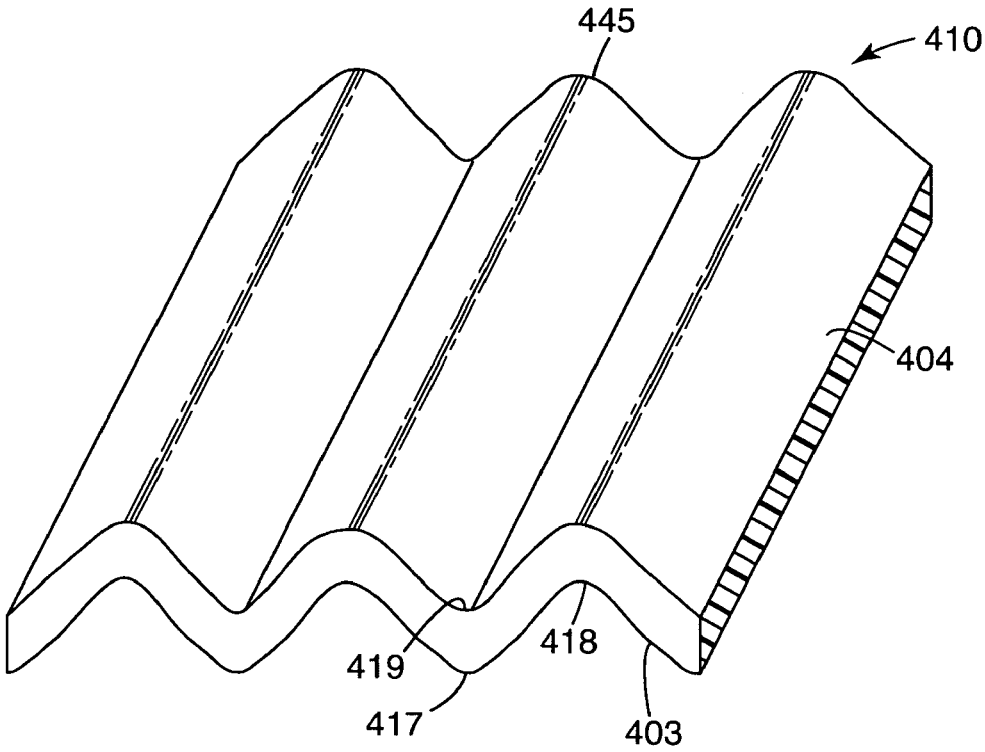
FIG. 27 is a perspective view of a precursor film used in accordance with the present invention.
Figure 28:
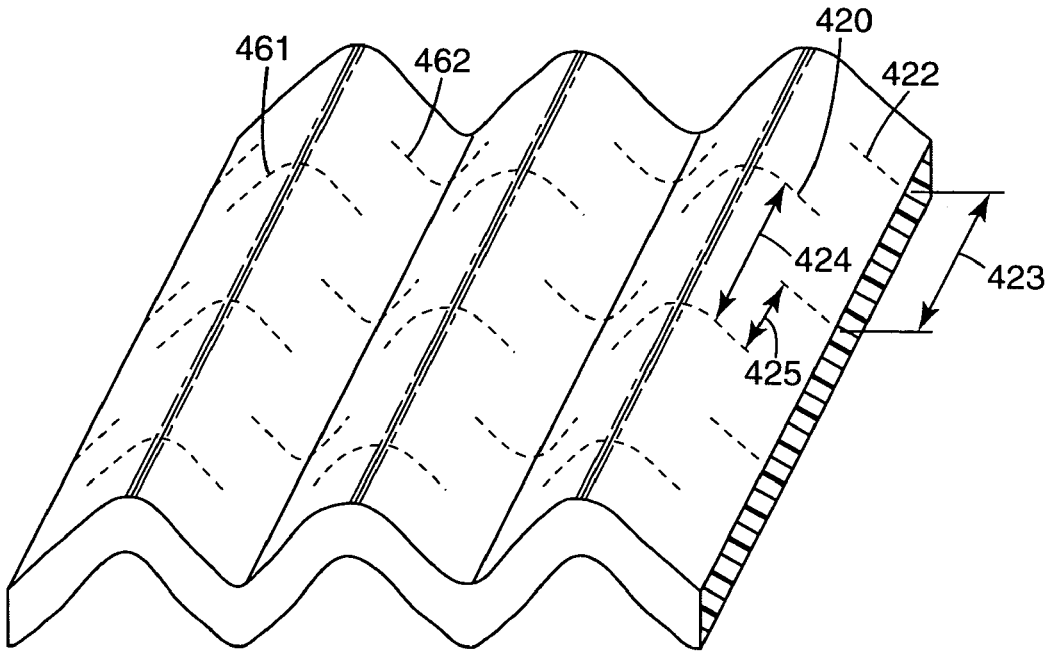
FIG. 28 is a perspective view of the FIG. 27 film cut on both faces.
Figure 29:
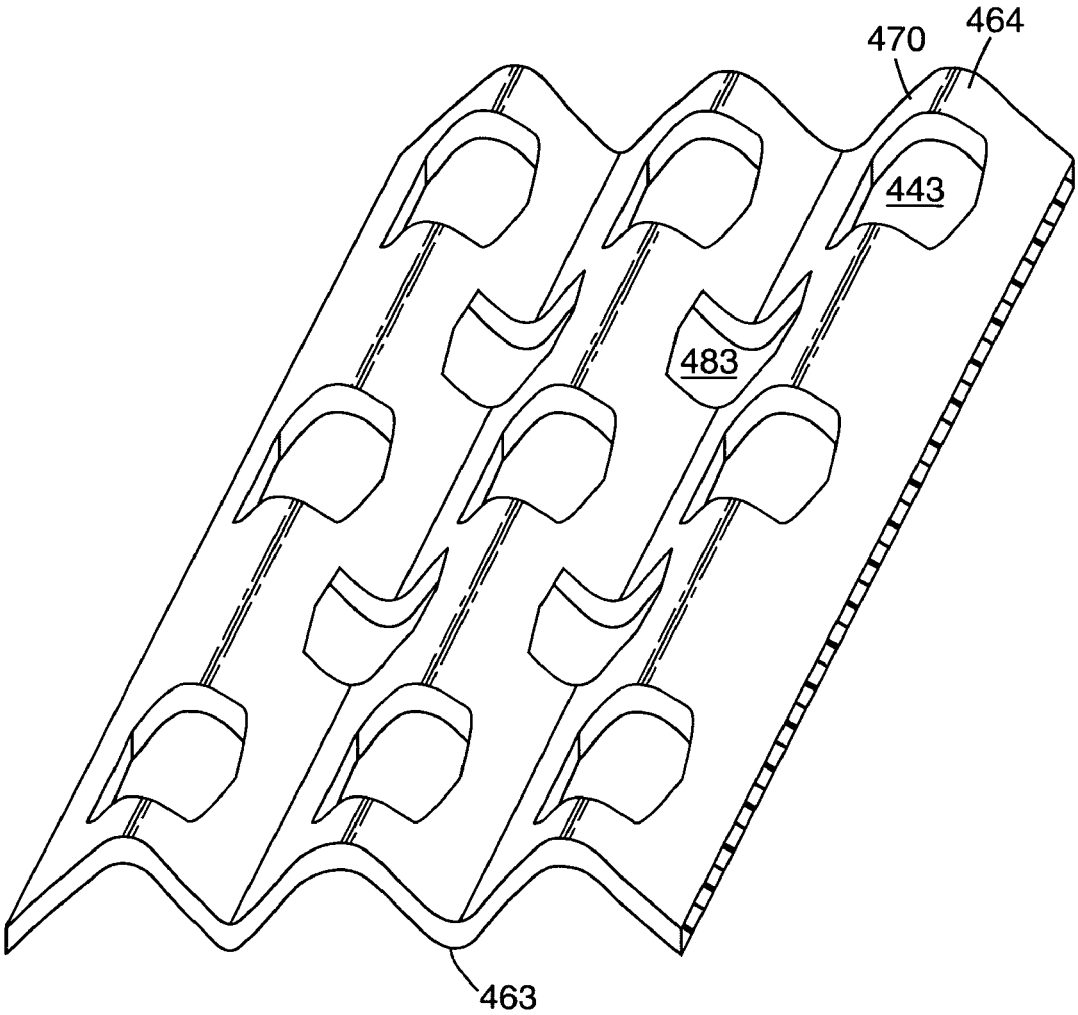
FIG. 29 is perspective view of a netting produced from the FIG. 28 cut film.

FIG. 27 is the FIG. 12 precursor film, which is then cut in accordance with FIG. 8, however, the cuts are substantially nonoverlapping rather than overlapping as in the FIG. 8 embodiment. This results in longitudinal strands formed primarily by the uncut portions. The cuts 461 and 462 are on either face and are equally spaced and offset. When this embodiment cut film, as shown in FIG. 28, is longitudinally stretched the resulting netting is as shown in FIG. 29. There are substantially no legs as in the FIG. 9 netting as the opposing cuts have substantially no overlap. In this embodiment, the longitudinal strands 470 are generally formed from the uncut portions 464 and 463 extending in the Z-direction. The spaces 443 and 483 are on different planes. This is a version of the FIG. 14 netting with spaces on either face but with discontinuous longitudinal strands. Longitudinal strand segments would tend to be oriented as there would be no legs to open up when the film is placed under tension.

Suitable polymeric materials from which the netting of the invention can be made include thermoplastic resins comprising polyolefins, e.g. polypropylene and polyethylene, polyvinyl chloride, polystyrene, nylons, polyester such as polyethylene terephthalate and the like and copolymers and blends thereof. Preferably the resin is a polypropylene, polyethylene, polypropylene-polyethylene copolymer or blends thereof.

The netting can also be a multilayer construction such as disclosed in U.S. Pat. Nos. 5,501,675; 5,462,708; 5,354,597 and 5,344,691, the substance of which are substantially incorporated herein by reference. These references teach various forms of multilayer or coextruded elastomeric laminates, with at least one elastic layer and either one or two relatively inelastic layers. A multilayer netting could also be formed of two or more elastic layers or two or more inelastic layers, or any combination thereof, utilizing these known multilayer coextrusion techniques.

Inelastic layers are preferably formed of semicrystalline or amorphous polymers or blends. Inelastic layers can be polyolefinic, formed predominately of polymers such as polyethylene, polypropylene, polybutylene, or polyethylene-polypropylene copolymer.

Elastomeric materials which can be extruded into film include ABA block copolymers, polyurethanes, polyolefin elastomers, polyurethane elastomers, EPDM elastomers, metallocene polyolefin elastomers, polyamide elastomers, ethylene vinyl acetate elastomers, polyester elastomers, or the like. An ABA block copolymer elastomer generally is one where the A blocks are polyvinyl arene, preferably polystyrene, and the B blocks are conjugated dienes specifically lower alkylene diene. The A block is generally formed predominately of monoalkylene arenes, preferably styrenic moieties and most preferably styrene, having a block molecular weight distribution between 4,000 and 50,000. The B block(s) is generally formed predominately of conjugated dienes, and has an average molecular weight of from between about 5,000 to 500,000, which B block(s) monomers can be further hydrogenated or functionalized. The A and B blocks are conventionally configured in linear, radial or star configuration, among others, where the block copolymer contains at least one A block and one B block, but preferably contains multiple A and/or B blocks, which blocks may be the same or different. A typical block copolymer of this type is a linear ABA block copolymer where the A blocks may be the same or different, or multi-block (block copolymers having more than three blocks) copolymers having predominately A terminal blocks. These multi-block copolymers can also contain a certain proportion of AB diblock copolymer. AB diblock copolymer tends to form a more tacky elastomeric film layer. Other elastomers can be blended with a block copolymer elastomer(s) provided that they do not adversely affect the elastomeric properties of the elastic film material. A blocks can also be formed from alphamethyl styrene, t-butyl styrene and other predominately alkylated styrenes, as well as mixtures and copolymers thereof. The B block can generally be formed from isoprene, 1,3-butadiene or ethylene-butylene monomers, however, preferably is isoprene or 1,3-butadiene.

With all multilayer embodiments, layers could be used to provide specific functional properties in one or both directions of the netting or hook netting such as elasticity, softness, stiffness, bendability, roughness or the like. The layers can be directed at different locations in the Z direction and form hook element cut portions or uncut portions that are formed of different materials. For example, if a cut portion is elastic, this results in a net which is elastic in at least the transverse or cut direction. If the uncut portions are elastic this would result in a netting that may be closed but is elastic in the longitudinal direction.

Hook Dimensions

Figure 6A:
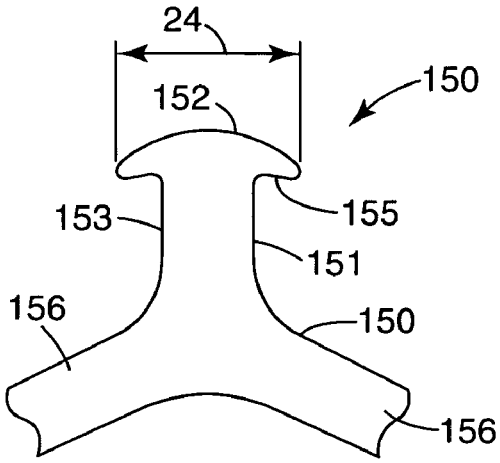
FIG. 6*a* is a schematic side view of an individual cut portion of FIG. 6.
Figure 6B:
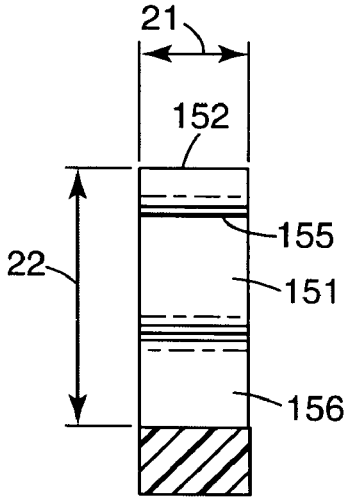
FIG. 6*b* is a schematic end view of an individual cut portion of FIG. 6.
Figure 7:
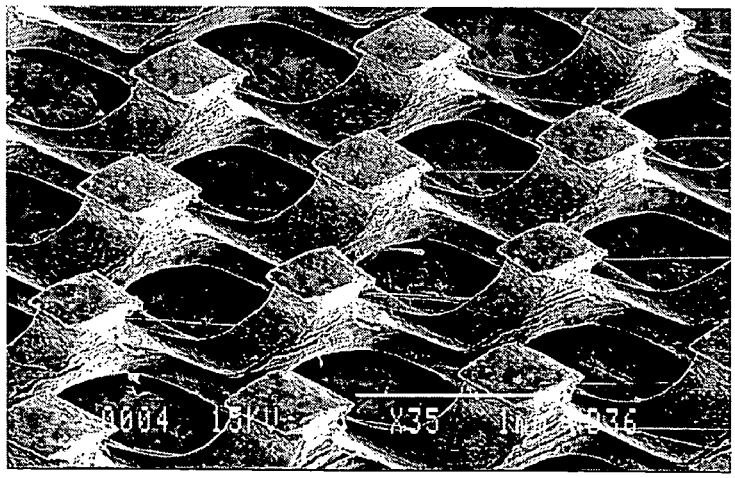
FIG. 7 is a photomicrograph perspective view of the netting of FIG. 6.

The dimensions of the reticulated webs were measured using a Leica microscope equipped with a zoom lens at a magnification of approximately 25×. The samples were placed on a x-y moveable stage and measured via stage movement to the nearest micron. A minimum of 3 replicates were used and averaged for each dimension. The base film thickness and hook rail height was measured both before and after the orientation step. In reference to the Example hooks, as depicted generally in FIGS. 6*a* and 6*b* hook width is indicated by distance 24, hook height is indicated by distance 22, and hook thickness is indicated by distance 21.

EXAMPLE 1

Figure 2:
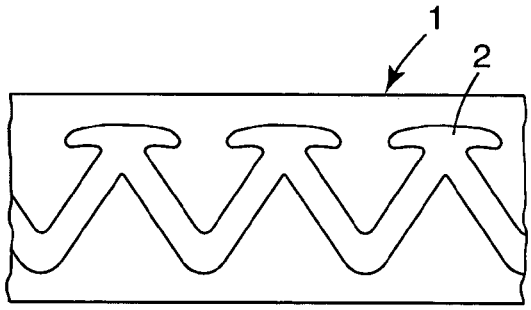
FIG. 2 is a cross-sectional view of a die plate used to form a precursor film used in accordance with the present invention.

A mesh hook netting was made using apparatus similar to that shown in FIG. 1. A polypropylene/polyethylene impact copolymer (C104, 1.3 MFI, Dow Chemical Corp., Midland, Mich.) was extruded with a 6.35 cm single screw extruder (24:1 L/D) using a barrel temperature profile of 177° C.-232° C.-246° C. and a die temperature of approximately 235° C. The extrudate was extruded vertically downward through a die and die plate having an opening cut by electron discharge machining as shown in FIG. 2, to produce an extruded profiled web similar to that shown in FIG. 3. The crossweb spacing of the hook ribs was 12 ribs per cm. After being shaped by the die plate, the extrudate was quenched in a water tank at a speed of 6.1 meter/min with the water being maintained at approximately 10° C. The web was then advanced through a cutting station where the hook ribs and part of the base layer were transversely cut at an angle of 23 degrees measured from the transverse direction of the web. The spacing of the cuts was 305 microns. After cutting the upper ribs and the top of the base layer, the web was longitudinally stretched at a stretch ratio of approximately 3 to 1 between a first pair of nip rolls and a second pair of nip rolls to further separate the individual hook elements to approximately 9.4 hooks/cm to produce a hook mesh netting similar to that shown in FIG. 5. The upper roll of the first pair of nip rolls was heated to 143° C. to soften the web prior to stretching. The second pair of nip rolls were cooled to approximately 10° C. Structural dimensions of the unstretched precursor web and the stretched web are shown in Table 1 below.

TABLE 1

| | Precursor Web (microns) | Example 1 (microns) |
|---|---|---|
| Hook Width (μ) | | 390 |
| Hook Height (μ) | | 320 |
| Hook Thickness (μ) | | 305 |
| Total Thickness (μ) | | 710 |
| Base Thickness (μ) | 340 | 210 |
| Amplitude (μ) | 530 | 410 |
| Hook Spacing (CD, /cm) | | 12.0 |
| Hook Spacing (MD, /cm) | | 9.4 |

We claim:

1. A nonplanar polymeric netting comprising, a plurality of a first set of strands extending in a first direction relative to a planar face of the netting and a second set of strands extending in a second direction relative to a planar face of the netting, wherein at least one set of strands has multiple leg portions, the first set of strands intersecting the second set of strands at connection points, wherein the first and second sets of strands at the connection points are an integral continuous homogeneous polymeric material and at the connection points at least two separate and adjacent leg portions of a strand, of one of the sets of strands connect, the at least two separate and adjacent leg portions of a strand that connect at a connection point each have a top surface and a bottom surface that are in an opposing relationship wherein the at least two separate and adjacent leg portions of a strand and their two opposing top surfaces their two opposing bottom surfaces extend along their length dimensions in different planes at the connection point, such that the at least two separate and adjacent leg portions intersect a strand of the other set of strands at the connection point in a thickness direction Z at an angle $\alpha$, of greater than zero, wherein the angle $\alpha$ is measured from a planar face of the netting, the at least one set of strands having leg portions being non-planar with the intersecting set of strands being non-planar and/or nonrectilinear.

2. The nonplanar netting of claim 1 wherein the percent open area of the netting is at least 50 percent.

3. The nonplanar netting of claim 1 wherein the percent open area of the netting is at least 60 percent.

4. The nonplanar netting of claim 1 wherein the first set of strands extend in the transverse direction and are nonplanar and the second set of strands extend in the longitudinal direction and are nonrectilinear.

5. The nonplanar netting of claim 1 wherein at least one of said sets of strands are oriented strands.

6. The nonplanar netting of claim 5 wherein the other set of strands are not oriented and have a substantially rectilinear cross-section.

7. The nonplanar netting of claim 1 wherein at least one sets of strands has substantially rectilinear cross-sections.

8. The nonplanar netting of claim 1 wherein at least one of said sets of strands are linear.

9. The nonplanar netting of claim 1 wherein both sets of strands are nonlinear.

10. The nonplanar netting of claim 1 wherein at least one of said sets of strands have surface structures on a face of the strands.

11. The nonplanar netting of claim 10 wherein said surface structures are stems extending upward.

12. The nonplanar netting of claim 11 wherein said stem structures have hook elements projecting in at least one direction.

13. The nonplanar netting of claim 12 wherein said hook elements extend in the direction of one of the sets of strands.

14. The nonplanar netting of claim 12 wherein said hook elements extend in two or more directions.

15. The nonplanar netting of claim 1 wherein said first and second set of strands are integrally formed from a thermoplastic polymer.

16. The nonplanar netting of claim 15 wherein said polymer is a thermoplastic polymer.

17. The nonplanar netting of claim 12 wherein the netting is non-self-engaging.

* * * * *

UNITED STATES PATENT AND TRADEMARK OFFICE

CERTIFICATE OF CORRECTION

PATENT NO. : 7,241,483 B2
APPLICATION NO. : 10/863720
DATED : July 10, 2007
INVENTOR(S) : Ronald W. Ausen It is certified that error appears in the above-identified patent and that said Letters Patent is hereby corrected as shown below:

Column 2 First Page (Foreign Patent Documents),
Line 2, delete "WO 93/009690" and insert -- WO 93/09690 --, therefor.

Column 5,
Line 7, delete "sonic" and insert -- some --, therefor.

Column 7,
Line 42, delete "144 '" and insert -- 144' --, thererfor. (Consider space)

Column 10,
Line 25 (approx.), in Claim 1, delete "comprising," and insert -- comprising --, therefor.
Line 40 (approx.), in Claim 1, after "surfaces" insert -- and --.

Signed and Sealed this

Twentieth Day of November, 2007

JON W. DUDAS
*Director of the United States Patent and Trademark Office*